United States Patent [19]

Gosset

[11] 4,263,532

[45] Apr. 21, 1981

[54] MICROWAVE DELAY LINE

[75] Inventor: Philippe Gosset, Paris, France

[73] Assignee: Thomson-CSF, Paris, France

[21] Appl. No.: 104,733

[22] Filed: Dec. 18, 1979

[30] Foreign Application Priority Data

Dec. 22, 1978 [FR] France ..... 78 36251

[51] Int. Cl.[3] ..... H01P 9/00; H01P 9/02; H01J 23/27

[52] U.S. Cl. ..... 315/3.5; 333/156; 333/162; 315/39.3

[58] Field of Search ..... 315/3.5, 3.6, 39.3; 333/156, 162 X, 163

[56] References Cited

U.S. PATENT DOCUMENTS

| | | | |
|---|---|---|---|
| 3,121,819 | 2/1964 | Wilmarth | 315/3.6 |
| 3,413,512 | 11/1968 | Buck | 315/3.5 |
| 3,548,345 | 12/1970 | Falce | 315/3.5 X |
| 3,716,745 | 2/1973 | Phillips | 315/3.6 |

*Primary Examiner*—Marvin L. Nussbaum
*Attorney, Agent, or Firm*—Roland Plottel

[57] ABSTRACT

A microwave delay line, which has a periodic geometrical structure involving more particularly the repetition of first and second meshes so that the amplitude of the inverse mode of transmission is reduced compared with that of a helical line, which comprises rods made from a dielectric and good heat conducting material, arranged parallel to the line axis and regularly distributed over its periphery. These rods are equally subdivided into first and second groups, which are regularly distributed over the line periphery. The rods of the first group are brazed to the first meshes of the line and insulated from the second meshes and the rods of the second group are brazed to the second meshes of the line and insulated from the first meshes.

3 Claims, 2 Drawing Figures

MICROWAVE DELAY LINE

BACKGROUND OF THE INVENTION

The present invention relates to microwave delay lines. It also relates to travelling wave tubes having such lines.

As is known the delay line associated with a travelling wave tube functioning as an amplifier ensures the interaction between an electron beam, focussed in accordance with the line axis, and the fundamental transmission mode of the ultra-high frequency travelling wave passing along the line, with a phase velocity close to that of the beam. The electrons transfer energy to the ultra-high frequency wave and there is then an amplification of the ultra-high frequency energy circulating on the line.

At present helical delay lines are used in travelling wave tubes. The disadvantage of these lines in that they bring about the oscillation on the inverse mode of travelling wave tubes for low peak power levels.

Therefore delay lines with a more complicated construction are used and for which the amplitude of the wave transmission inverse mode which causes the oscillation of the travelling wave tube is reduced compared with that of a helical line. Thus, these lines less easily bring about the oscillation of travelling wave tubes and travelling wave tubes functioning as amplifiers with high peak powers can be obtained. It is thus possible to use double helix lines, constituted by two identical helixes of the same longitudinal axis which constitutes the axis of the line, said helixes coming from a same point and having opposite winding directions. Ring and bar or ring and loop lines are also widely used. They are formed by rings, arranged perpendicularly with respect to the transmission direction of the electron beam constituting the axis of the line, two successive rings being connected by a bar parallel to the axis of the line (ring and bar) or by a loop (ring and loop) and two successive bars or two successive loops are diametrically opposed with respect to the rings.

The problem which the present invention aims at solving occurs when the double helix delay lines or the ring and bar and ring and loop lines, which make it possible to increase the HF peak power of travelling wave tubes functioning as an amplifier to which they are connected, are welded, generally by brazing to rods made from a dielectric and good heat conducting material and which are positioned parallel to the axis of the line.

It is known to braze microwave delay lines to rods made from a dielectric and good heat conducting material arranged parallel to the line axis and whose face opposite to that which is brazed to the line is brazed to the sleeve containing the line. The brazing of the rods improves the dissipation of heat between the line and the sleeve and the average power of travelling wave tubes having rods brazed to the line and the sleeve can be approximately ten times higher than that of tubes having rods which are only secured between the line and the sleeve.

When the double helix delay lines of the ring and bar and ring and loop types are brazed to rods, the distance between two successive brazing points being substantially half that existing in the case of a helical line ensuring the same phase velocity of the ultra-high frequency travelling wave, the HF average power of the tubes using these lines is increased, but the HF peak power thereof is limited because breakdowns due to a too strong electrical field occur along the rods between two successive brazing points for a peak power which can be reached by these tubes. The problem which then occurs is that of limiting the peak power of these tubes. This problem is made even greater because it is in practice impossible to forecast the peak power value which brings about the breakdown of the rods due to the irregularity of the brazing points obtained. Thus, on brazing the rods to the line the brazed seam is differently distributed from one case to the next and the breakdown voltage of the rods between two brazed seams is consequently subject to considerable variations.

BRIEF SUMMARY OF THE INVENTION

The present invention relates to a microwave delay line for which the amplitude of the inverse mode of transmission of the wave is reduced compared with that of a helical line. This line has a periodic geometrical structure involving the repetition of a first and a second mesh. Rods made from a dielectric and good heat conducting material are arranged parallel to the axis of the line and are regularly distributed over its periphery. These rods are subdivided equally into first and second groups regularly distributed over the line periphery. The rods of the first group are welded to the first meshes of the line and insulated from the second meshes and the rods of the second group are welded to the second meshes of the line and insulated from the first meshes.

The present invention therefore makes it possible to double the distance between two successive welds, which are generally produced by brazing, whilst maintaining regular heat elimination from each of the first and second meshes of the line. The distance between two successive welds being doubled, there is no longer a problem of limiting the peak power of the tubes having double helix lines, ring and bar and ring and loop lines, due to voltage breakdowns of the insulants. The peak power of these tubes can therefore be increased in a simple manner and permits the use thereof, particularly in the space telecommunications field, in place of travelling wave tubes having delay lines with coupled cavities, which have larger overall dimensions and which are more costly.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
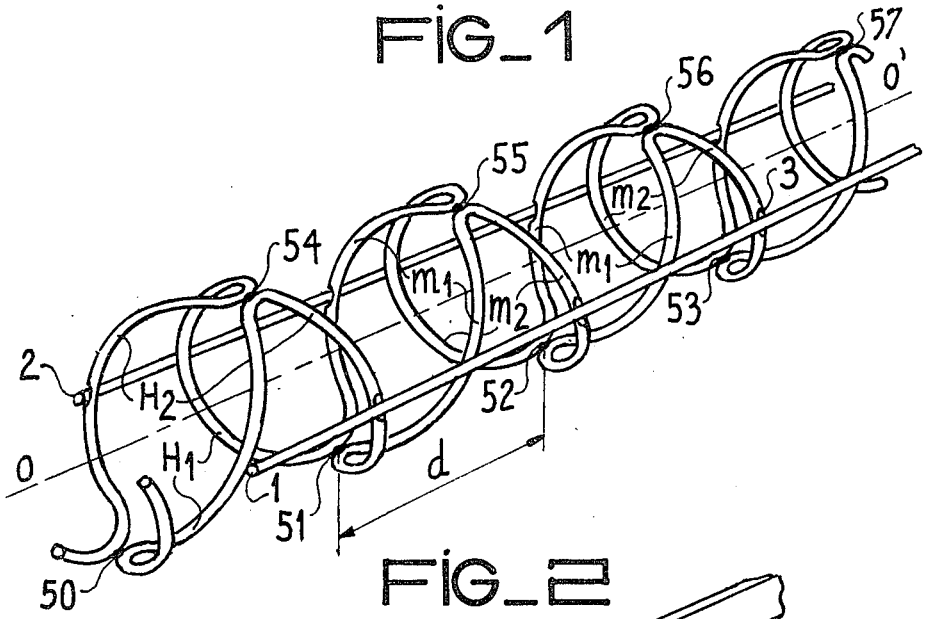
FIG. 1 a prespective view of a double helix delay line according to the invention.

In the drawings the same reference numerals designate the same elements but, for reasons of clarity the dimensions and proportions of the various elements have not been respected.

FIG. 1 is a perspective view of a double helix delay line according to the invention having two helixes $H_1$ and $H_2$. The double helix delay line can be obtained by assembling two helixes, by machining a cylindrical tube or by brazing at points 50 to 57 of two undulated conductors in the manner shown in FIG. 1. Therefore the double helix line has a periodic geometrical structure involving the repetition at the end of a distance d, which is equal to the pitch of each helix, of a first and a second mesh $m_1$ and $m_2$, constituted by a half-turn of each helix. FIG. 1 shows two rods made from a dielectric and good heat conducting material, such as for example alumina and beryllium oxide. These rods are arranged parallel to axis 00' of the line and are regularly spaced over its periphery. According to the invention one of the rods 1 is welded and generally brazed to the first meshes $m_1$ of the line and is insulated from the second meshes and the other rod 2 is welded and generally brazed to the second meshes $m_2$ and insulated from the first meshes. To this end in FIG. 1 the first and second meshes $m_1$ and $m_2$ have a flat 3 at the locations where they respectively face the rods 2 and 1, which are respectively welded to the second and first meshes. It is also possible to make a boss on the first and second meshes where they are respectively welded to the rods 1 and 2. The distance between two successive welds is therefore equal to d, which is the pitch of helixes $H_1$ and $H_2$. Each of these helixes used separately would make it possible to obtain a phase velocity of the ultra-high frequency travelling wave equal to that obtained with the double helix and a distance equal to d between two successive welds, but the limiting peak power of the tube would be lower than in the case of the double helix.

Figure 2:
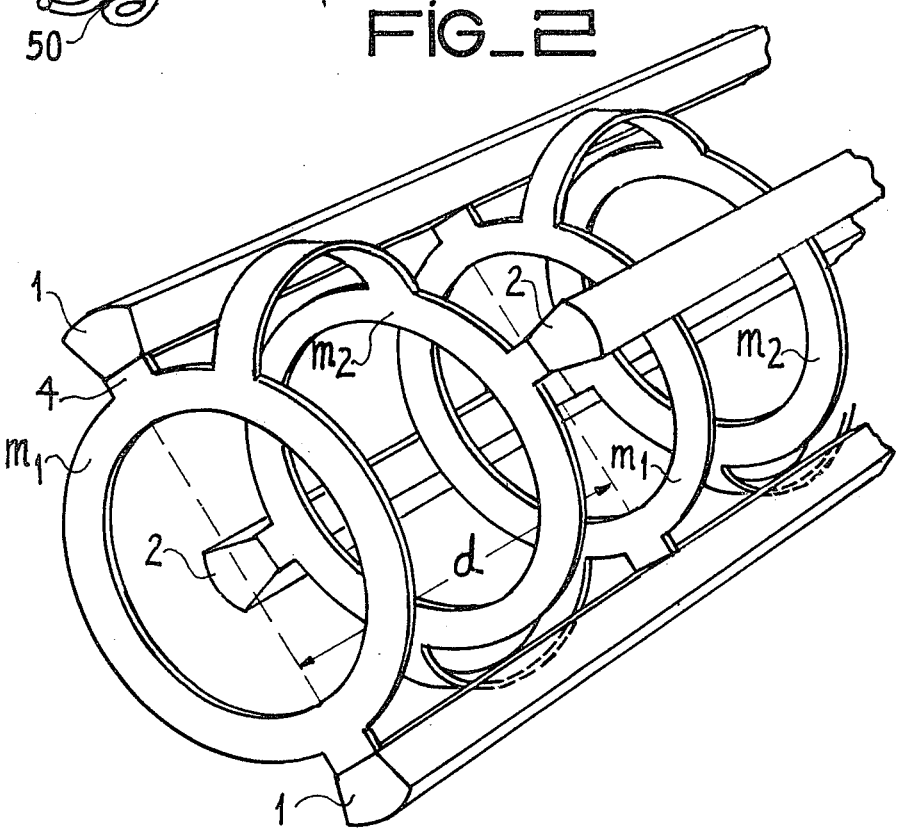
FIG. 2 a perspective view of a ring and loop delay line according to the invention.

The invention therefore makes it possible to double the distance existing between two successive welds and each mesh $m_1$ and $m_2$ of the helix has a heat elimination regularly effected at the end of a distance d, which is equal to the pitch of each helix $H_1$ and $H_2$. FIG. 2 is a perspective view of a ring and loop delay line according to the invention. This line can for example be produced from a chemically or mechanically cut metal strip, which is then folded back onto itself in alternating manner and with the desired pitch.

In FIG. 2 four rods are regularly distributed over the line periphery. These rods are equally subdivided into first and second groups 1 and 2, regularly distributed over the line periphery. The first and second meshes of line $m_1$ and $m_2$, repeated along the line at the end of a distance equal to d are constituted by identical rings. In FIG. 2 the first and second meshes have a boss 4 at the location where they are welded and generally brazed respectively to the rods of the first and second groups 1 and 2. These bosses can be made during the cutting of the metal plate. The number of rods can be varied and can in particular be two, four or six.

The invention also applies to ring and bar-type lines, which are not shown in the drawings, as well as to all other lines for which the transmisson inverse mode is reduced compared with that of a helical line and which have a periodic geometrical structure involving particularly the repetition of first and second meshes. For ring and bar-type lines the first and second meshes which are repeated along the line are constituted by two successive rings.

The invention also applies to variable period lines, whose turns can have a random shape and a variable evolute length.

The invention is not limited to the embodiments described and represented hereinbefore and various modifications can be made thereto without passing beyond the scope of the invention.

What is claimed is:

1. A microwave delay line which ensures, in a travelling wave tube, the interaction between an electron beam focussed along the axis of the line and the fundamental transmission mode of the ultra-high frequency travelling wave passing along said line at a phase velocity close to that of the beam, the amplitude of the inverse mode of wave transmission being reduced compared with that of a helical microwave delay line, wherein it has a periodic geometrical structure involving more particularly the repetition of first and second meshes and wherein rods made from a dielectric and good heat conducting material are arranged parallel to the axis of the line and are regularly distributed over its periphery, said rods being subdivided equally into first and second groups regularly distributed over the line periphery, the rods of the first group being welded to the first meshes of the line and insulated from the second meshes and the rods of the second group are welded to the second meshes of the line and are insulated from the first meshes.

2. A delay line according to claim 1, wherein the first and second meshes have a boss at the point where they are respectively welded to the rods of the first and second groups.

3. A delay line according to claim 1, wherein the first and second meshes have a flat at the locations where they face the rods respectively of the second and first groups which are welded to the second and first meshes.

* * * * *